United States Patent [19]

Lin

[11] Patent Number: 5,060,631

[45] Date of Patent: Oct. 29, 1991

[54] FIREPLACE SCREEN

[76] Inventor: Patrick Lin, 14 Fl., No. 598, Min Sheng E. Rd., Taipei, Taiwan

[21] Appl. No.: 621,522

[22] Filed: Dec. 3, 1990

[51] Int. Cl.[5] ..... F24B 1/192

[52] U.S. Cl. ..... 126/544; 160/229.1; 160/135

[58] Field of Search ..... 126/544, 548; 160/229.1, 135

[56] References Cited

U.S. PATENT DOCUMENTS 1,413,364 4/1922 Smith ..... 160/229.1

1,588,529 6/1926 Cranshaw ..... 160/229.1

2,323,699 7/1943 Babros ..... 160/135

*Primary Examiner*—Carroll B. Dority

*Attorney, Agent, or Firm*—Renner, Otto, Boisselle & Sklar

[57] ABSTRACT

A fireplace screen constructed with a pair of connecting rods each surrounded by a protective housing, above each connecting rod is a round capping washer and a nut and washer. A connecting member connects nuts, washers, capping washers, and connecting rods, with threaded ends of the connecting rods engaging with the nuts. A bolt connects the connecting member and the cap-like enclosure by engaging with a decorative finial.

1 Claim, 5 Drawing Sheets

FIREPLACE SCREEN

BACKGROUND OF THE INVENTION

The present invention relates to an improved fireplace screen.

FIGS. 4 and 5 of the drawings show a conventional fireplace screen. It can be seen that the fireplace screen is constructed with a pair of connecting rods (A) each surrounded by a protecting tube (B). Each connecting rod (A) is attached to wire mesh (C). A central rod (E) having two threaded end portions (F) is placed between the pair of the connecting rods (A). Above the connecting rod (A) is a round capping washer (D). Above the capping washer (D) lies a 2-tier connecting piece (G). The lower portion of the connecting piece has two symmetric side holes (H) and a center hole (J), whereas the upper portion of the connecting piece has a center hole (J). Each connecting rod (A) passes through the hole of the capping washer (D) and the side hole (H) of the lower connecting piece, whereas the central rod (E) passes through the center hole (J) of the lower and upper connecting pieces. A cap-like enclosure (K) with a center hole (L) and a decorative finial (M) with a lower inner-threaded hole engages with the threaded end portion (F) of the central rod (E). The lower portion of the fireplace screen has a symmetic structure to the upper portion thereof, except for the decorative finial.

Such prior art fireplace screens suffer from several disadvantages. It is complicated to assemble this kind of fireplace screen, and it has numerous parts. Furthermore, if the finial of the fireplace screen were not securely tightened, the whole screen could fall apart easily.

It is the purpose of this present invention, therefore, to mitigate and/or obviate the abovementioned drawback in the manner set forth in the detailed description of the preferred embodiment.

SUMMARY OF THE INVENTION

Accordingly, it is an object of this invention to provide an improved fireplace screen which is easily assembled with lower cost.

A further object of this invention is to provide a fireplace screen having a rigid structure which is durable and will not easily fall apart.

Further objects and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 3:
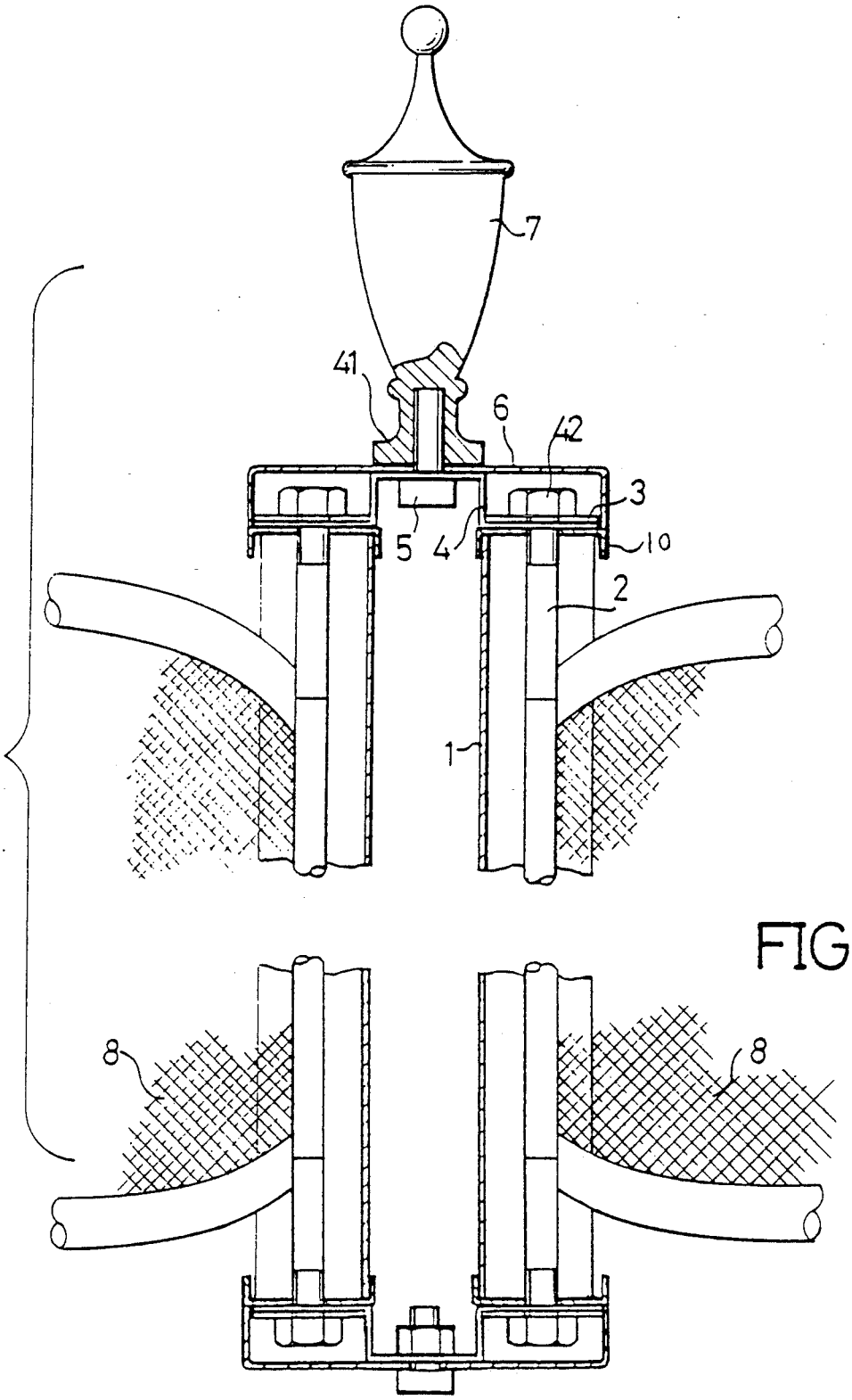
FIG. 3 is a schematic cross-sectional view of the fireplace screen according to the present invention.
Figure 4:
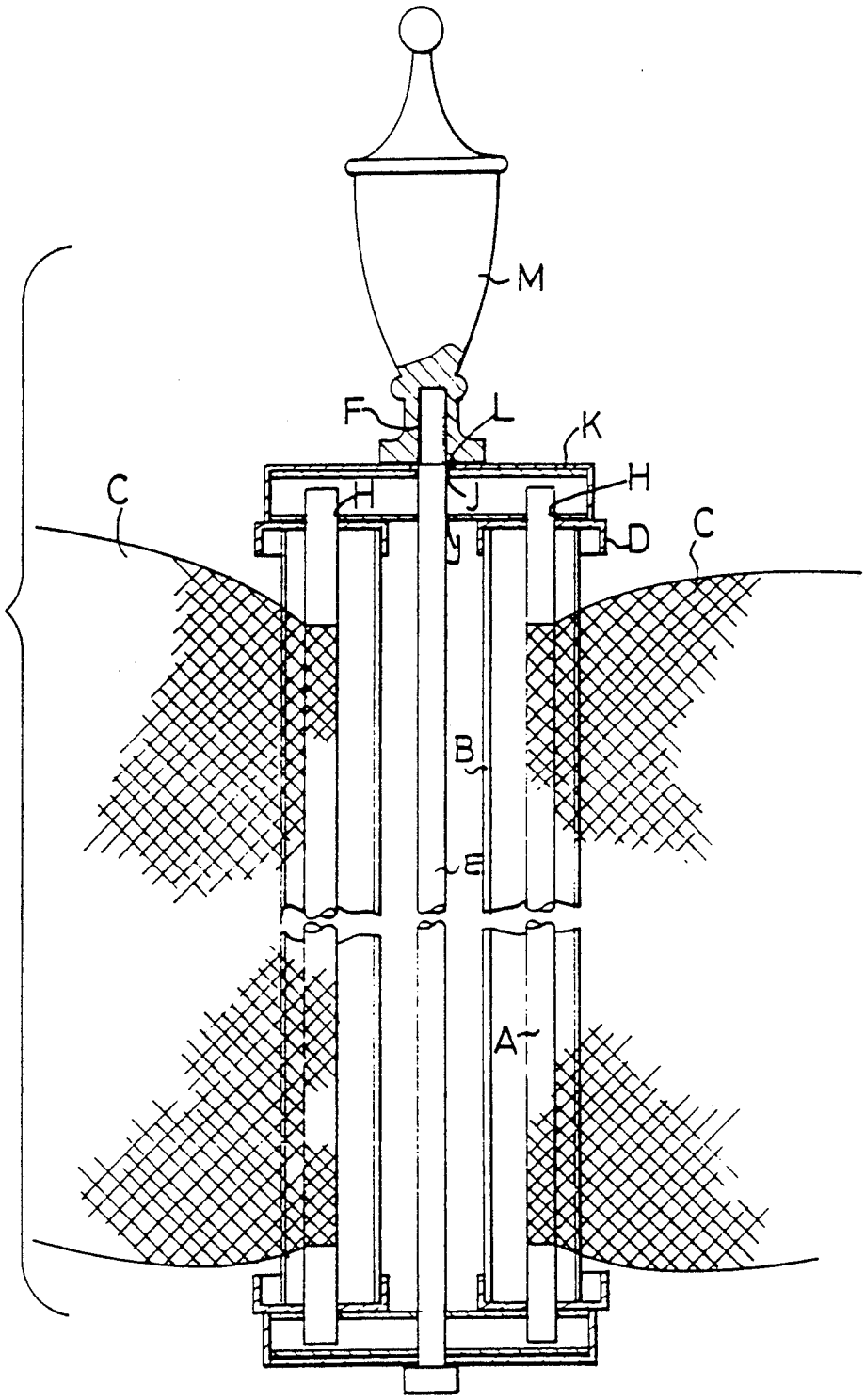
FIG. 4 PRIOR ART
FIG. 4 is a partial cross-sectional view of a well known fireplace screen.
Figure 5:
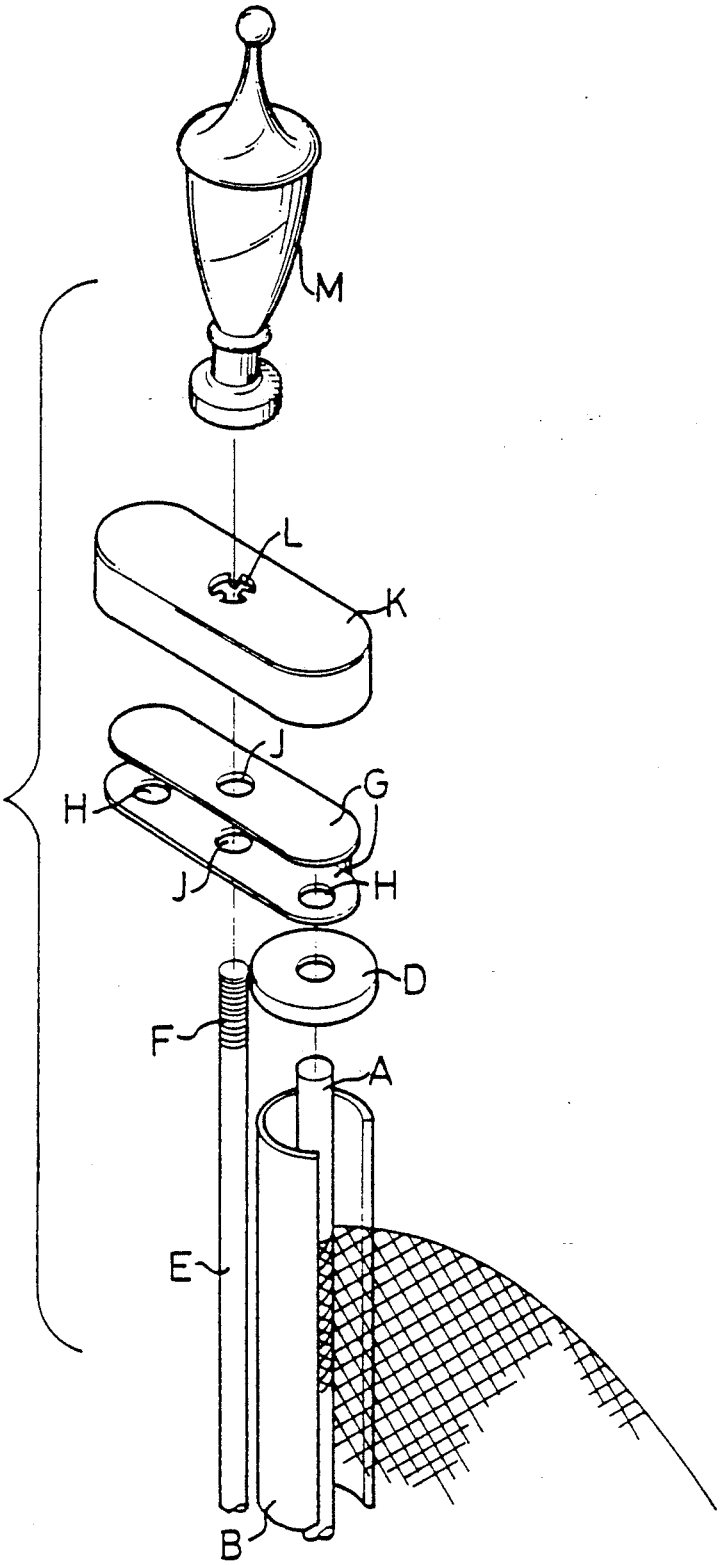
FIG. 5 PRIOR ART
FIG. 5 is a partial exploded view of the fireplace screen of FIG. 4.

In reference to FIG. 3, it can be seen that the fireplace screen according to the present invention is substantially symmetrical with respect to a central horizontal axis, i.e., symmetric upper and lower portions. It should be known that the following detailed description will only describe the present invention with respect to a singular portion, the upper portion, and that the description for the lower portion of the invention will be identical.

Figure 1:
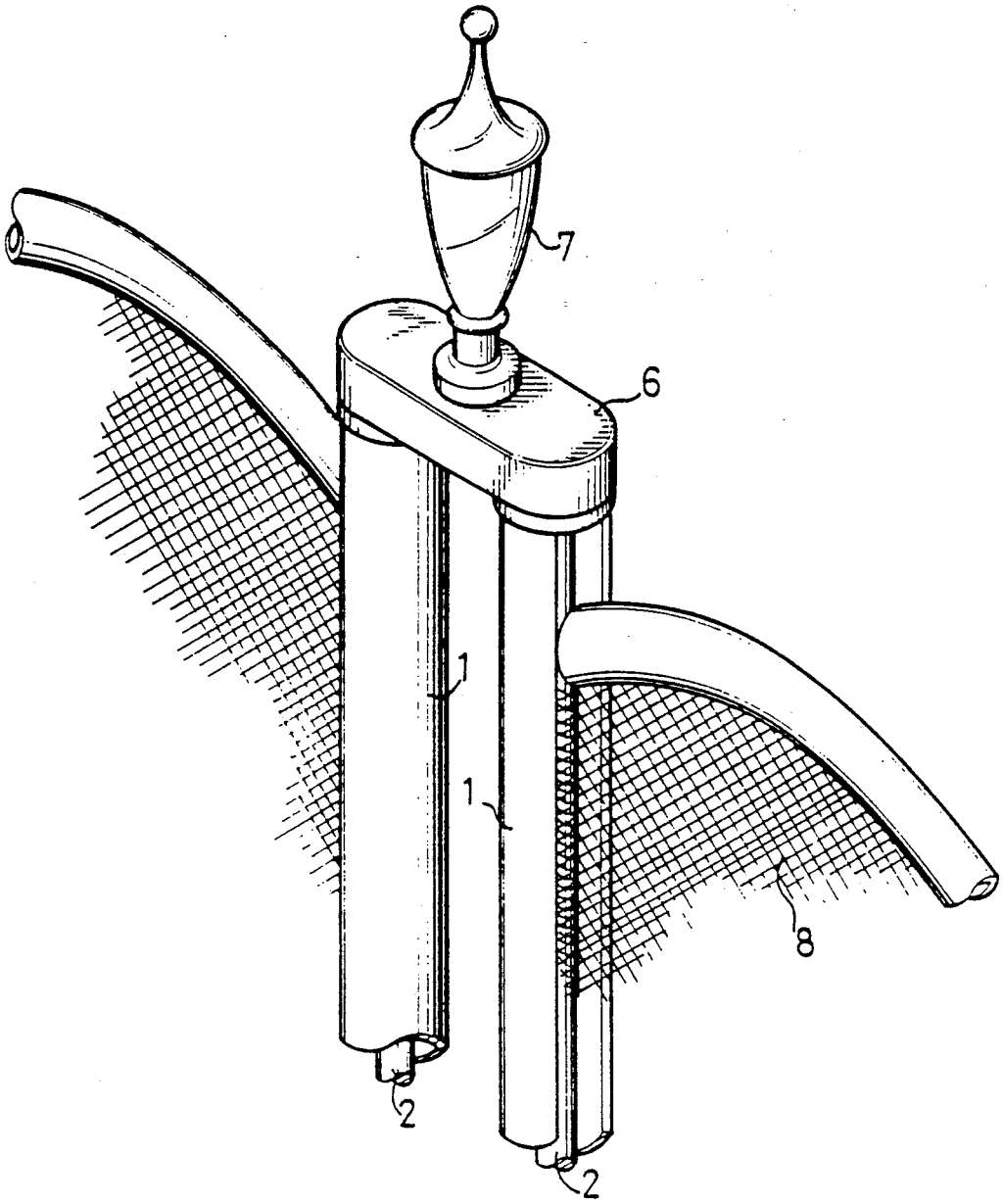
FIG. 1 is a partial perspective view of the fireplace screen in accordance with the present invention.
Figure 2:
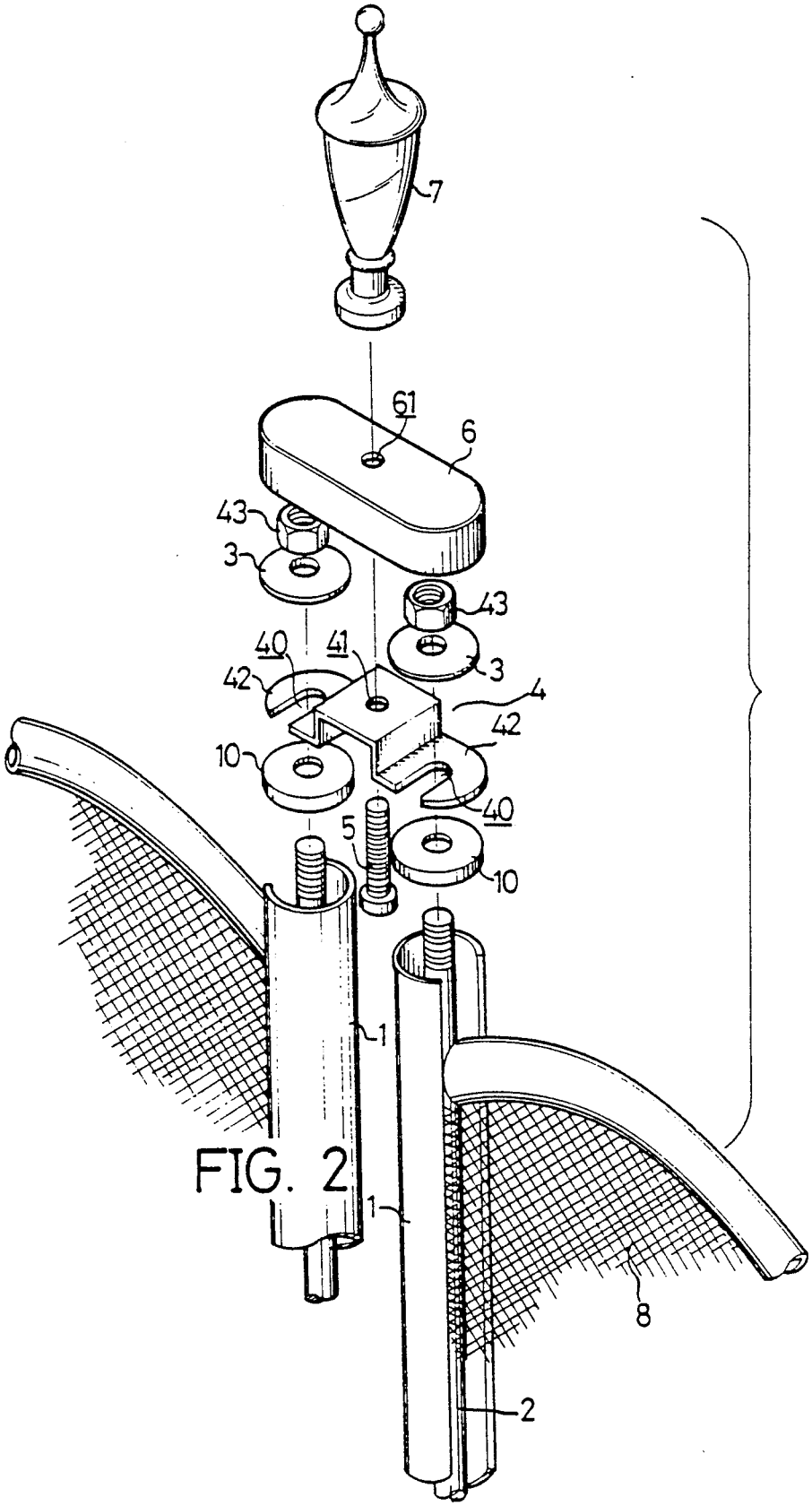
FIG. 2 is an exploded view of the fireplace screen shown in FIG. 1.

Referring to FIGS. 1 through 3, the fireplace screen according to the present invention is constructed with a pair of connecting rods 2, each surrounded by a protective housing 1 and attached to wire mesh 8, and each connecting rod 2 has a threaded end portion. Round capping washers 10, having center through holes, are provided on top of the protective housings 1 with the threaded end portions of the connecting rods 2 passing through the center through holes of the capping washers 10.

Nuts 43 and washers 3 are provided on top of each capping washer 10 for engaging with the threaded end portions of the connecting rods 2 (but not 100% tightened).

A connecting member 4 comprises a central hole 41 and two wings 42 extending outwardly from a bottom edge thereof, and each wing 42 having a U-shaped notch 40 centrally provided thereon. The wings 42 are inserted between the capping washers 10 and washer 3 with the notches 40 aligned with the center through holes of the capping washers 10 such that the threaded portions of the connecting rods 2 also pass therethrough.

A cap-like enclosure 6 having a center hole 61 encloses the nuts 43, washers 3 and connecting member 4. Above the cap-like enclosure 6 is placed a decorative finial 7. A bolt 5 passes through the central hole 41 and the center hole 61 and engages with finial 7 to secure the connecting member 4 with the enclosure 6.

It should be known the only difference between the upper and lower portions of the screen is that the upper portion provides a decorative cap-nut 7 to secure the connecting member 4 to the enclosure 6 where the lower portion provides a common nut and bolt fastening means (not labeled) to serve this function.

Accordingly, the improved fireplace screen provides an easy and convenient assembly of parts with lower cost, and a rigid structure to avoid the screen falling apart which is superior to conventional fireplace screen.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A fireplace screen comprising:

a pair of connecting rods each surrounded by a protective housing and each attached to fireproof meshing, and each said connecting rod having two threaded end portions;

a round capping washer having a center through hole being provided on two ends of each said protective housing with each said threaded end portion of each said connecting rod passing through said center through hole;

a nut and second washer being provided on top of each said capping washer for engaging with each said threaded end portion of each said connection rod;

a connecting member having two wings extending outwardly from a bottom edge thereof, each said wing provided in between the said capping washer and second washer; each said wing having a U-shaped notch to be inserted to each said threaded end portion of each said connecting rod;

a cap-like enclosure enclosing each said connecting member;

a threaded means extending from said connecting member through said cap-like enclosure and threadably connected to a finial for securing each said cap-like enclosure to each said connecting member.

* * * * *